United States Patent [19]

Suska

[11] 4,267,619

[45] May 19, 1981

[54] CONTROLLED RELEASE DOOR HOLDER

[75] Inventor: Charles R. Suska, Roxbury, Conn.

[73] Assignee: The Stanley Works, New Britain, Conn.

[21] Appl. No.: 279,198

[22] Filed: Aug. 9, 1972

Related U.S. Application Data

[63] Continuation-in-part of Ser. No. 220,815, Jan. 26, 1972, abandoned.

[51] Int. Cl.[2] ..... E05F 3/10; E05F 3/12; E05F 3/22

[52] U.S. Cl. ..... 16/48.5; 16/52; 16/DIG. 17

[58] Field of Search ..... 16/48.5, 52, 53, 55, 16/62, DIG. 10, DIG. 17; 49/2, 31; 137/540

[56] References Cited

U.S. PATENT DOCUMENTS

| | | | |
|---|---|---|---|
| 2,353,161 | 7/1944 | Heigis et al. | 137/540 X |
| 2,680,453 | 6/1954 | Prijatel | 137/540 X |
| 3,042,957 | 7/1962 | Muessel et al. | 16/62 |
| 3,087,720 | 4/1963 | Catlett | 16/62 X |
| 3,207,179 | 9/1965 | Klagues | 137/540 |
| 3,337,992 | 8/1967 | Tolson | 49/2 X |
| 3,470,652 | 10/1969 | Forbes | 49/2 |
| 3,696,462 | 10/1972 | Martin | 16/55 X |

FOREIGN PATENT DOCUMENTS

| | | | |
|---|---|---|---|
| 6703679 | 9/1967 | Netherlands | 16/62 |
| 978966 | 1/1965 | United Kingdom | 16/52 |

*Primary Examiner*—Roy D. Frazier
*Assistant Examiner*—P. A. Aschenbrenner
*Attorney, Agent, or Firm*—Brumbaugh, Graves, Donohue & Raymond

[57] ABSTRACT

A controlled release door holder comprises a housing having a portion defining a cylinder for containment of a fluid, a piston received in the cylinder for movement axially thereof and dividing the cylinder into first and second chambers, and a linkage between the piston and the door for moving the piston in the cylinder as a function of door movement. A spring compressed between the piston and housing biases the door toward the closed position. Three hydraulic paths communicate the sections of the cylinder on either side of the piston: the first path includes a check valve that allows one-way flow from the spring side to the other side as the door is opened; a second path, which includes a pressure relief valve, allows flow from the other side to the spring side when the door is pushed closed, but resists the spring pressure and holds the door in any desired position; a controllable valve responds to control signals to shunt the fluid pressure generated by the spring in the other side of the cylinder to the spring side so that the spring force acting on the piston moves the door, by force transmission through the linkage, toward closed position.

5 Claims, 12 Drawing Figures

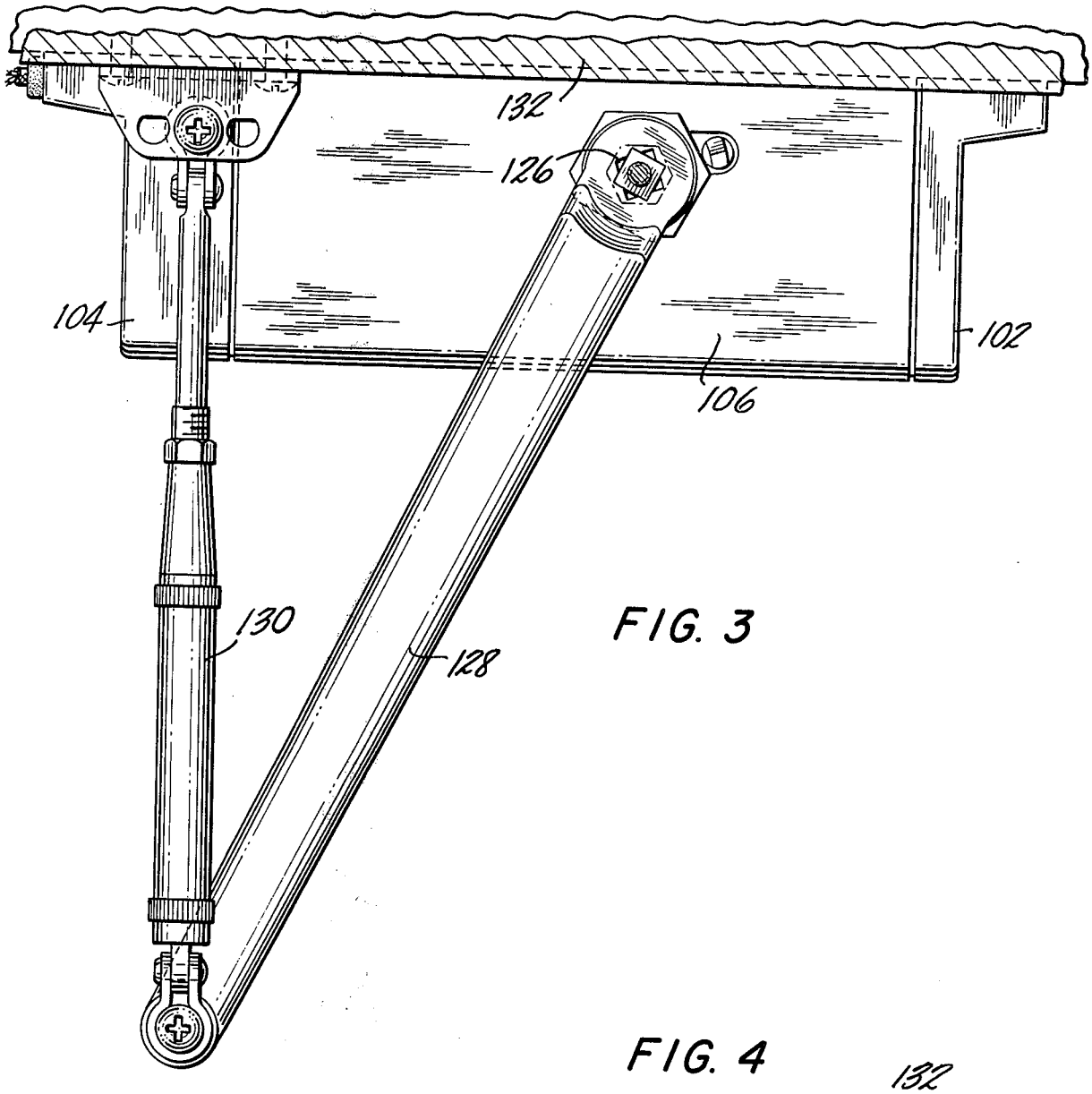
FIG. 3
FIG. 4
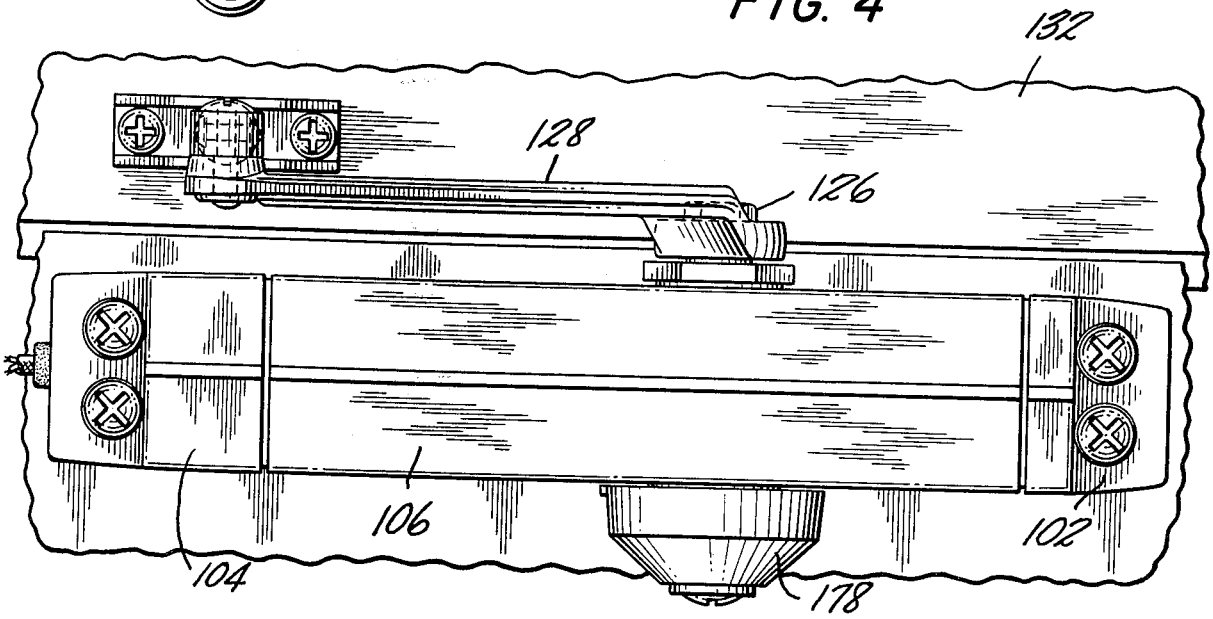

CONTROLLED RELEASE DOOR HOLDER

This application is a continuation-in-part of my copending application Ser. No. 220,815, filed Jan. 26, 1972 now abandoned.

BACKGROUND OF THE INVENTION

This invention relates to a door holder and, more particularly, to a device that normally holds the door in a manually set position but automatically closes the door in response to a control signal, such as a signal from a smoke or heat sensor.

It is frequently desirable for a door to be held in some manually set position between fully open and fully closed, but also to be readily moved from one point to another or fully closed. Some types of door closers can be set to hold a door at a desired position, normally fully open, but require adjustment of the closer mechanism to hold any other given, preset positions.

A separate, but related, aspect of door control involves automatic closing of the door upon occurrence of some dangerous situation in a building. One of the most serious and frequently occurring forms of danger in buildings is a fire. Any fire in any building is a threat to the lives of the occupants, but the most hazardous consequences of fire are in hospitals, nursing homes or other buildings occupied by ill, incapacitated or confined persons. These types of buildings are also most likely to provide doors that are kept partially or fully open so that the residents are readily observed by medical and other attendant personnel.

SUMMARY OF THE INVENTION

There is provided, in accordance with the invention, a controlled release door holder which normally holds a door in a manually set position, can be opened and closed to any position from almost closed to fully opened, but responds to a control signal by automatically closing. Although the door holder of the invention may be used for various purposes, an especially advantageous use is as a part of a fire and smoke safety system that involves automatic closing of doors equipped with the door holder in response to a signal from a heat or smoke sensor. For example, doors opening onto corridors in hospitals and nursing homes or other facilities which have many doors which are frequently kept open and involve occupants who may not, through illness or dehabilitation, be able to seek safety in the event of a fire or smoke hazard may be equipped with a door opener of the invention. A system composed of several door openers may be under the control of a single heat detector, smoke detector, or both, to provide zone systems in a building.

A controlled release door closer, in accordance with the invention, comprises a housing having a portion that defines a cylinder for containment of a fluid, preferably a hydraulic fluid, and a piston received in the cylinder for axial movement. The piston divides the cylinder into (1) a first variable volume section on one side of the piston and (2) a second variable volume section on the other side of the piston. A spring in the first section of the cylinder urges the piston in the direction of the second section and tends to reduce the volume of the second section and increase the volume of the first section. The piston is arranged, such as by mechanical drive and linkage acting between the door and a fixed member adjacent the door closer, so that the piston is moved axially in the cylinder a distance that is a function of the degree of incremental movement of the door relative to the door opening between fully opened and fully closed. The movement of the piston is in a direction against the spring as the door is opened. In other words, when the door is opened, the piston is driven in the cylinder in a direction to compress the spring and establish in the spring a potential energy that will be recovered as the door is closed.

There are three fluid flow paths between the two sections of the cylinder. A first flow path permits fluid to flow from the first section to the second section and includes a check valve for preventing fluid from backflowing from the second section to the first section. Thus, the first flow path allows the piston to transfer fluid from the first section to the second section when the door is being moved from closed toward opened. A second path permits fluid flow from the second section to the first section and includes a pressure relief valve for preventing such flow in the absence of a set minimum pressure developed in the second section. This value of pressure is established somewhat above the pressure generated in the second section by the force applied by the spring to the piston. Accordingly, the door will not close automatically due to fluid flow from the second section to the first section by way of the second flow path but must be manually pushed closed. A third flow path includes a controllable valve for selectively preventing or permitting fluid flow in either direction between the two sections of the cylinder on either side of the piston. In the normal operation of the system, the valve is normally closed but is opened in response to a control signal, such as a signal indicative of potentially dangerous ambient heat or smoke conditions (or both) to allow flow of fluid from the second section of the cylinder to the first section. The spring urges the piston in a direction to force fluid from the second section to the first section through the third path whenever the controllable valve is opened, and such movement of the piston results in closing of the door.

In a preferred embodiment, the door closer is mounted on the door, and an articulating mechanical linkage is connected at one end to the piston by a pair of coacting gears and at the other end to a door frame or other fixed structure adjacent the door. The gear coupling and mechanical linkage provide movement of the piston in the cylinder to an extent and in a direction that is a function of the extent and direction of movement of the door. The relief pressure of the pressure relief valve in the second fluid flow path of the door holder is set to resist the spring force normally to prevent the door from closing. When the door is pushed manually, the pressure exceeds the relief pressure, causing fluid to flow through the pressure relief valve allowing the door to move toward its closed position.

An optional, but quite advantageous, feature that may be built into the door holder comprises a device for sensing the position of the door relative to the door opening. The controllable valve is responsive to the sensing device so that when the door is almost, but not quite, fully closed, the valve opens to permit energy from the spring to assist in completing the closing of the door and to facilitate latching. In other words, the hydraulic resistance is reduced to permit fluid to flow more easily, thereby enabling the operator to close and latch the door with less exerted force. The device involved for this feature may be a relatively simple cam formed to indicate the normal closed position of the door and operating a switch that is in a circuit that controls the controllable valve.

DESCRIPTION OF THE DRAWINGS

For a better understanding of the invention, reference may be made to the following description of an exemplary embodiment, taken in conjuction with the figures of the accompanying drawing, in which:

FIG. 3 is a top view of the door holder showing details of an articulating linkage connecting the door holder to the door frame;

FIG. 4 illustrates a front elevational view of the door holder with the holder attached to the door and the linkage connected by its base to the door frame header;

DESCRIPTION OF AN EXEMPLARY EMBODIMENT

Figure 2:
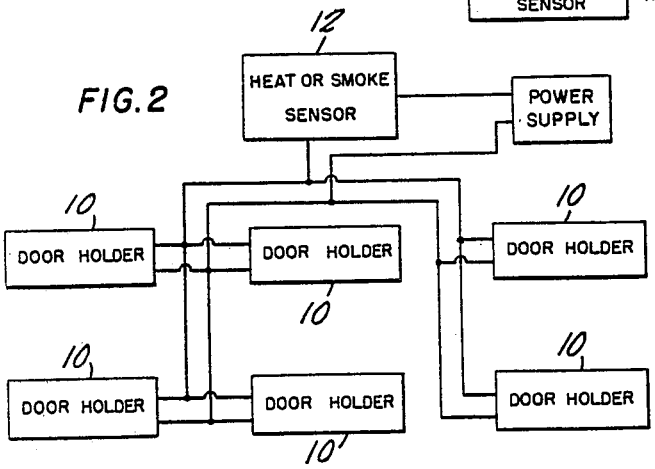
FIG. 2 is a diagram of a fire and smoke safety system that employs a controlled release door holder on each of multiplicity of doors.

Referring first to FIG. 2, an advantageous installation of a controlled release door holder is in a fire and smoke safety system in which several doors, say in a zone of a building, each of which is equipped with a door holder 10, are under the control of a heat or smoke sensor 12. The sensor 12 controls each of the several door holders 10 in the zone and automatically closes all doors controlled by it in the event of the detection by the sensor of a dangerous level of smoke, heat, or both. It will be readily apparent to those skilled in the art that the number of doors under the control of a given sensor may vary from one to any practical number, even several dozen. In general, however, relatively small zones, the sizes of which are dictated by the architecture of the building, will be covered by individual sensors 12 that control a relatively small number of doors.

Figure 1:
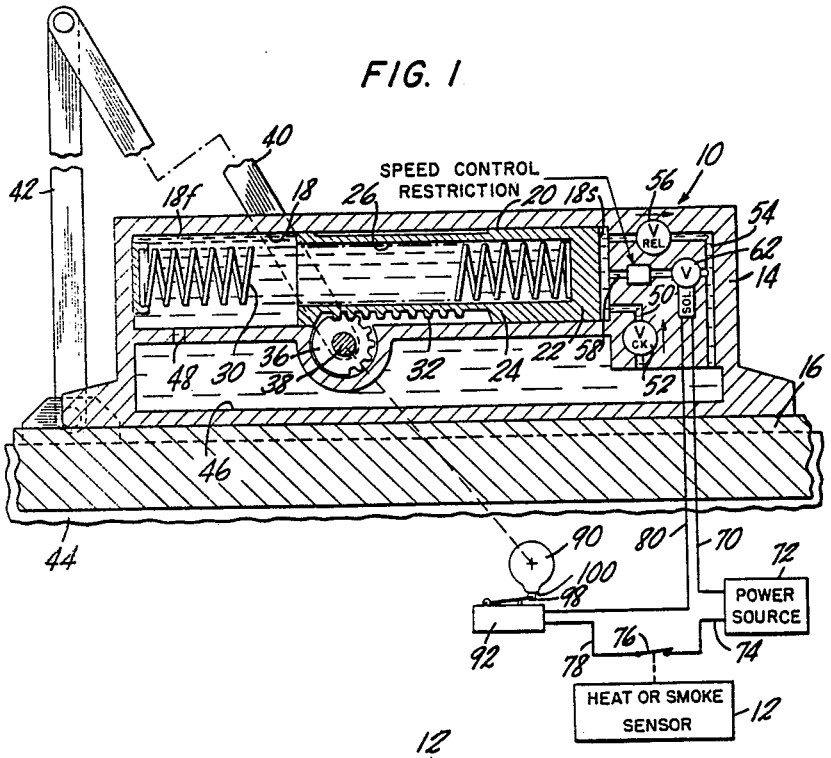
FIG. 1 is a cross-sectional view taken generally horizontally through a portion of a vertical door viewed from below equipped with the embodiment, the view being generally schematic.

Referring now to FIG. 1, the door holder 10 comprises a housing 14 which is appropriately secured to a door 16. Within the housing is a fluid cylinder 18 that receives for axial movement therein a piston 20. The piston 20 subdivides the cylinder 18 into two sections, a first section **18*f* (to the left in FIG. 1) and a second section 18*s* (to the right in FIG. 1). The piston 20 includes a head 22 and a cylindrical skirt 24 that defines an internal bore 26. A spring 30 is compressed between one end wall of the cylinder and the internal face of the piston head 22**.

A rack gear 32 is formed along a portion of the external wall of the cylindrical skirt 24 of the piston and meshes with a pinion gear 36 that is fixed on a rotatable shaft 38. One arm 40 of an articulating linkage is also affixed to the shaft 38, and the other arm 42 of the linkage is secured to the frame 44 of the door. When the door is opened or closed, the angle between the two arms 40 and 42 of the linkage changes, thereby causing a change in the angle between the arm 40 and the plane of the door 16 and, hence, rotation of the shaft 38 and the gear 36. The gear, acting through the rack gear 32, drives the piston 20 in one direction or the other along the cylinder, depending upon which direction the door is moved. Accordingly, the piston moves axially in the cylinder to an extent and in a direction that are functions of any incremental movement of the door between open and closed positions.

The two sections **18*f* and 18*s* of the cylinder 18 are filled with a hydraulic fluid, and three fluid flow paths are provided between the two sections 18*f* and 18*s*. In the schematic illustration, all three flow paths include a common reservoir 46 formed within the housing and filled with the fluid. The reservoir 46 communicates with the section 18*f* of the cylinder through an opening 48** in the wall of the cylinder. It will be readily apparent to those skilled in the art that the reservoir arrangement may be replaced by piping or other appropriate forms of fluid communication devices.

A first flow path between the two sections **18*f* and 18*s* comprises a passage 50 having a one-way check valve 52 that permits flow from the section 18*f* to section 18*s* but precludes back flow in the opposite direction. The linkage and gear coupling between the door frame 44 and the piston 20 are arranged such that when the door is moved an increment from closed toward open, the piston is moved to the left (relative to FIG. 1), that is, in a direction toward the spring 30. Accordingly, the spring is compressed and stores energy, and fluid is transferred from the first section 18*f* of the cylinder through the opening 48, the reservoir 46, past the one-way check valve 52 and through the passage 50 to the right or second section 18*s*** of the cylinder.

A second fluid flow path between the two sections of the cylinder includes a passage or conduit 54 that is provided with a pressure-relief valve 56, such as a spring-loaded ball valve or similar biased valve device. The pressure-relief valve holds a pressure in the second cylinder section **18*s* that is at least equal to the pressure developed in the section 18*s* in the fluid by the force of the spring acting on the piston and is preferably somewhat in excess of that pressure. Accordingly, the fluid will not flow through the second path until a manual force is applied to the door of sufficient magnitude to generate a pressure increase that will open the pressure-relief valve 56. At that pressure, fluid will flow through the passage 54, the reservoir 46, the opening 48 and into the left or first section 18*f*** of the cylinder.

A third flow path between the two sections in the cylinder includes a branch passage 58 that includes a speed control restriction, such as a fixed or adjustable orifice 60, and a controllable valve 62, such as a solenoid-controlled valve. The valve 62 is normally closed in operation of the system so that communication via the third path between the two sections of the cylinder on either side of the piston is prevented. When the valve is opened in response to actuation of a sensor (described below), fluid may flow from the second section 18*s* through the passage 58, the speed control restriction 60, the valve 62, the passage 54, the reservoir 46 and the opening 48 into the first section 18*f* of the cylinder. The speed control restriction limits the flow rate through the third path to prevent an undesirably high speed of closing of the door.

From the foregoing, it is evident that any time the valve 62 is opened, the spring will force the piston in a direction toward the second section 18*s* of the cylinder, inasmuch as flow of fluid along the third path between the second section 18*s* and the first section of the cylinder 18 is permitted. The net force (above the force required to move the fluid) generated by the spring 30 is applied through the gears to the articulating linkage so that the door, so to speak, is pushed closed.

Whenever the controllable valve 62 is closed, which it normally is, movement of the piston, and consequently movement of the door, are prevented by mechanical pressure exerted by the spring 30, which prevents movement of the piston to the left (with reference to FIG. 1), and by development of a hydrostatic pressure in the section 18*s* of the cylinder, such pressure being held by the pressure-relief valve 56. Therefore, the door will hold any position in which it is manually set. Nonetheless, it is apparent that the door may be moved manually from one position to another.

As discussed above, a particularly advantageous use for a door closer, in accordance with the invention, is in a fire and smoke safety system. In such a system, the door is under the control of a heat or smoke sensor 12. More particularly, the solenoid valve 62 is connected by a lead 70 to one side of a power source 72. The other side of the power source is connected by lead 74, a sensor switch 76, lead 78, switch 92 and lead 80 to the solenoid. Upon actuation of the heat or smoke detector 12, the switch 76 opens to interrupt the circuit through the solenoid, thereby deenergizing it and opening the valve 62. As already described, the opening of the valve 62 allows fluid flow from section 18*s* to the section 18*f* of the cylinder under the force developed by the spring acting on the piston. The gear and mechanical linkage between the piston and the door frame transmits the spring force between the door and the door frame and causes the door to be closed.

Note that the solenoid valve 62 is preferably of the type that is open in the absence of current flow through its operating coil. In the event of power failure, due to fire or other cause, the doors will all close automatically, thus providing a fail safe feature.

As a further feature of the invention, but one which is optional, the solenoid valve 62 may also be controlled by a device that senses the position of the door and opens the valve 62 whenever the door is in a position between just slightly open and fully closed as an aid to manual closing and latching of the door. This result is obtained, for example, by providing, as a device for sensing the position of the door, a cam 90 that is mounted on or mechanically coupled to the shaft 38. The switch 92 is connected by leads 78 and 80 in series with the sensor switch 76 and is operated by the cam 90 through a cam follower 98. Over the major portion of the surface of the cam 90, the switch 98 is closed, so that the valve 62 remains closed. A raised formation 100 on the cam surface, however, opens the switch when the door is between its slightly open and closed positions, for example, when a latch on the door engages or is just about to engage the door latch strike (not shown). In such position, the opening of the switch 92 deenergizes the solenoid valve 62, thereby resulting in opening of the valve and allowing the spring force to more effectively aid in closing the door.

Thus, there is provided, in accordance with the invention, a novel and improved door holder that holds a door in any desired position between fully open and closed but permits the door to be easily manually moved between positions. Moreover, the controlled release feature of the door holder provides for full closing of the door from any open position in response to an appropriate control signal, such as a signal indicative of a heat or smoke danger. It will be readily apparent to those skilled in the art that the controlled release feature may be applied in circumstances other than heat or smoke danger; for example, the door holder might be used as part of a security system in which all doors may be closed and locked by automatically-locking latches in case of a security danger. Moreover, manual override switches may be used with the sensors to facilitate closing of the doors when desired. It will also be understood that other types of doors, such as sliding doors, may be controlled by the inventive door closer. Also the door closer may be mounted on either the door or the door frame, as desired.

Figure 5:
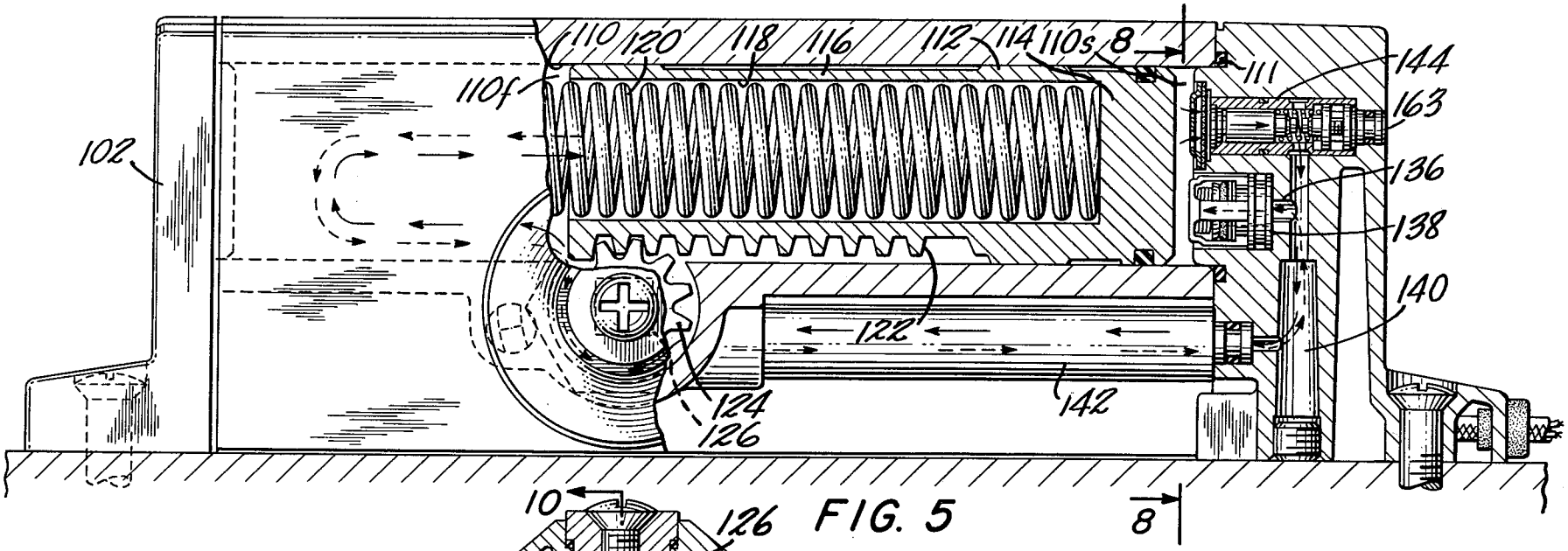
FIG. 5 is a top, partial cross-sectional view of the door holder showing its lower half and taken generally along the lines 5—5 of FIG. 6 and FIG. 8, in the direction of the arrows.
Figure 6:
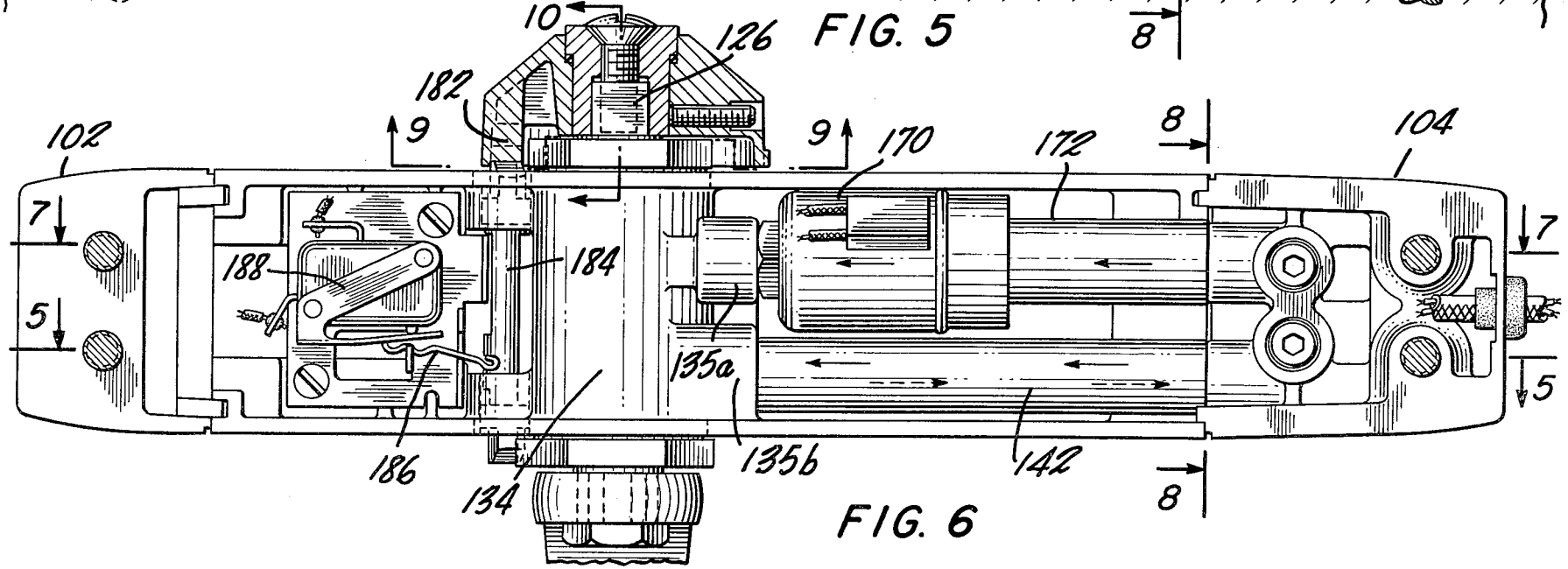
FIG. 6 is an elevational view of the door holder with portions broken away, and partly in section through the cam of a sensing device.
Figure 7:
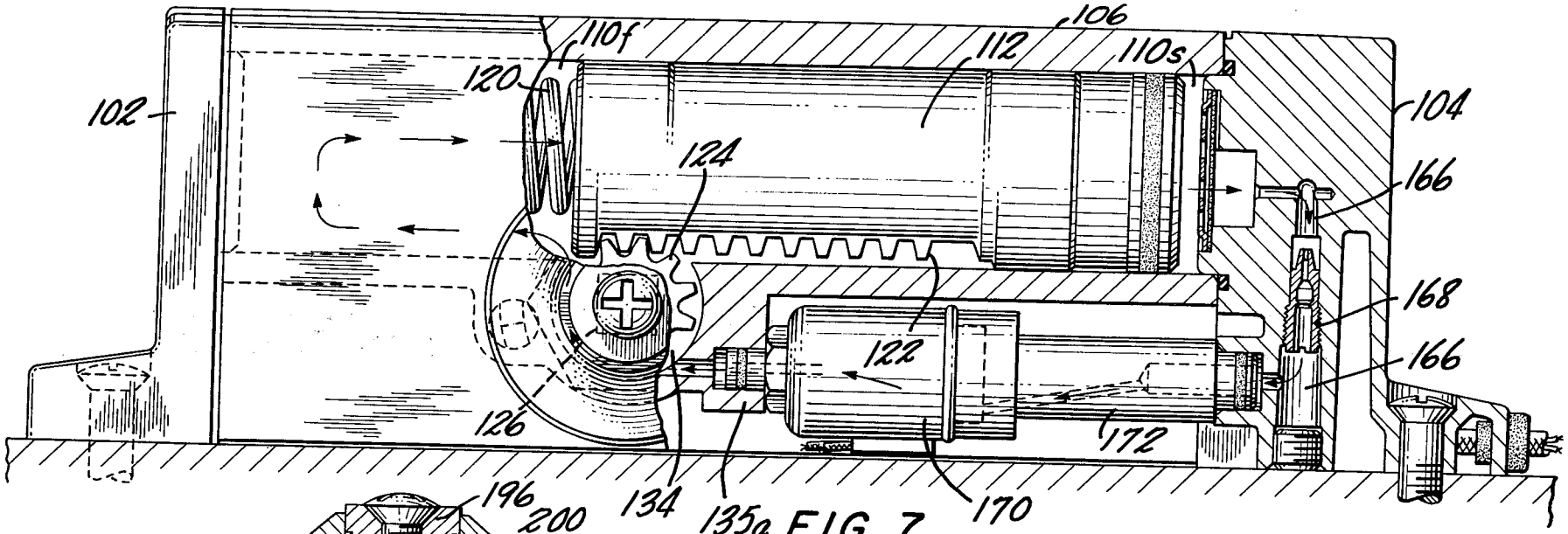
FIG. 7 is a top, partial cross-sectional view of generally the upper half of the holder, the view being taken generally along the lines 7—7 of FIG. 6 and FIG. 8, in the direction of the arrows.

FIG. 1 of the drawings and the above description relate to the embodiment generally; FIGS. 3 through 12 of the drawings and the description below show and describe additional details of the construction of the embodiment. As best shown in FIGS. 5 and 7, the door holder housing consists of two end members 102 and 104 and an elongated center member 106, which fits between the end members 102 and 104. These housing members are constructed with appropriate openings to receive and hold in place various component parts of the holder (as described hereinafter); i.e., the openings are formed conveniently to accept and closely to conform to the components such that when the housing members are fitted together, the components will be held in place. The housing members 102, 104 and 106 are secured together by screws 108 which pass through holes in the end members 102 and 104 and are threaded into tapped holes in the central housing member 106. This construction permits easy assembly and disassembly of the holder originally or for maintenance and repairs.

The fluid chamber of the holder is a cylindrical portion 110 that is sealed to the end members by seal rings (e.g., ring 111 of FIG. 5). The piston 112, which subdivides the cylinder 110 into two sections, a first section 110*f* (to the left in FIGS. 5 and 7) and a second section 110*s* (to the right in FIGS. 5 and 7), includes a head part 114 and a generally cylindrical skirt part 116 that defines an internal bore 118. A spring 120 is compressed between end member 102 and the internal face of the piston head 114.

A rack gear 122 is formed along a portion of the external wall of the cylindrical skirt 116 of the piston and meshes with a pinion gear 124 tht is fixed on a rotatable shaft 126. As shown in FIGS. 3 and 4, one arm 128 of an articulating linkage is also affixed to the shaft 126, and the other arm 130 of the linkage is secured to the frame 132 of the door. Movement of the door causes a corresponding movement through the linkage, of the piston 112 and the rack and pinion gears 122 and 124.

The two sections 110*f* and 110*s* of the cylinder 110 are filled with a hydraulic fluid, and three fluid flow paths are provided between the two sections 110*f* and 110*s*. As shown in FIGS. 5 and 6, all three flow paths include a common reservoir 134, which is formed within the central housing member 106 and also receives the pinion gear 124. The reservoir 134 is a cylindrical bore in the housing member 106 having its longitudinal axis oriented tangentially to the curved wall of the cylinder 110. The curved side walls of the reservoir 134 and the cylinder 110 intersect, resulting in a generally oval opening between the reservoir and the cylinder, through which the pinion gear 124 meshes with the rack gear 122. Two bosses 135*a* and 135*b* extend tangentially from the side wall of the reservoir 134, opposite the oval opening, in a direction paralleling the longitudinal axis of the cylinder 110 and comprise a portion of the above mentioned flow paths.

A first flow path between the two sections 110*f* and 110*s* comprises a passage 136 having a one-way check valve 138 that permits flow from the section 110*f* to section 110*s* but precludes flow in the opposite direction. The check valve 138 communicates directly at one end with section 110*s* of the cylinder and at the other end with the passage 136. The passage 136, in turn, joins a passage 140, formed in the end housing member 104, which is connected to a pipe 142 in the central housing member 106, as shown in FIG. 5. As shown in FIG. 6, the pipe 142 opens into the lower half of the reservoir 134 through the boss 135*b*. The check valve 138 functions in the same manner as the check valve 52 of FIG. 1. Movement of the piston 112 forces the fluid in section 110*f* to flow through the pipe 142 and the passages 140 and 136, past the check valve 138 and into the second section 110*s* of the cylinder.

Figure 11:
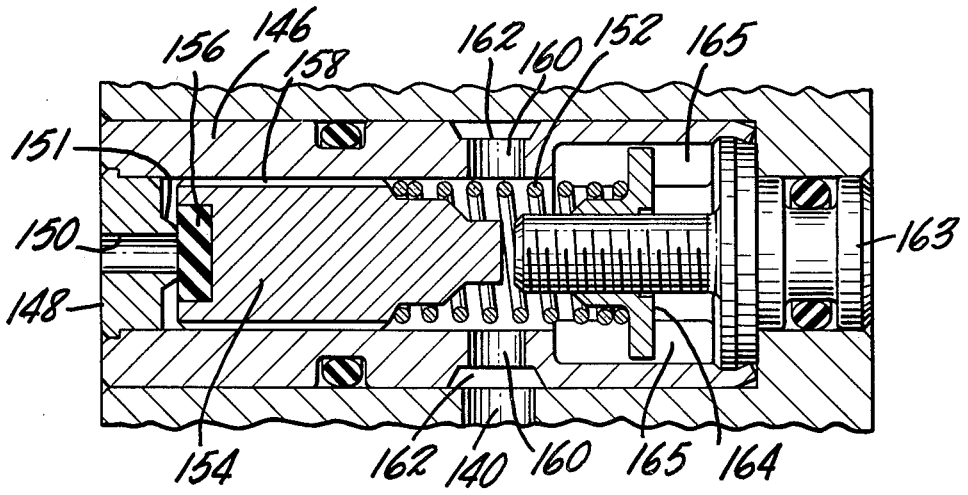
FIG. 11 is a cross-sectional view on an enlarged scale of the pressure release valve shown in FIG. 5.

A second fluid flow path between the two sections of the cylinder includes the pipe 142, the passage 140, and a pressure relief valve 144. As shown in FIG. 11, the pressure relief valve comprises a longitudinally extended, annular housing 146, covered at one end by a circular insert 148 having an opening 150 in its center and formed to define a valve seat 151. A force generated by fluid pressure in section 110*s* is transmitted to the valve through the opening 150 in the insert. This force is resisted by the force of a spring 152 which biases a valve seal member 156 on a cylindrical plunger 154 into sealing relationship with the valve seat 151. When the resistance of the spring 152 is overcome by generation of fluid pressure in section 110*s* of the cylinder, the hydraulic fluid passes into the housing 146 and along grooves 158 in the side of the plunger 154. At the other end of the plunger, the fluid flows out of the valve through a plurality of ports 160 spaced around the circumference of the housing 146. A circumferential groove 162 in the outer wall of the housing 146 receives the fluid and conducts it to the passage 140, from which it returns to section 110*f* of the cylinder 110. As in the valve 56 of the schematic view, FIG. 1, the valve 144 is actuated when manual force is applied to the door to close it. The magnitude of such is selected by adjusting the pressure exerted by the spring 152. Rotating the exposed end of a threaded stud 163 causes a threaded washer 164 mounted on the stud 163 and restraining the end of the spring 152 that is away from the plunger 154 to move longitudinally along the stud. A plurality of protrusions 165 in the interior wall of the housing 146 engages serrations in the circumference of the washer 164 and prevent the washer 164 from merely rotating with the stud 163.

Figure 8:
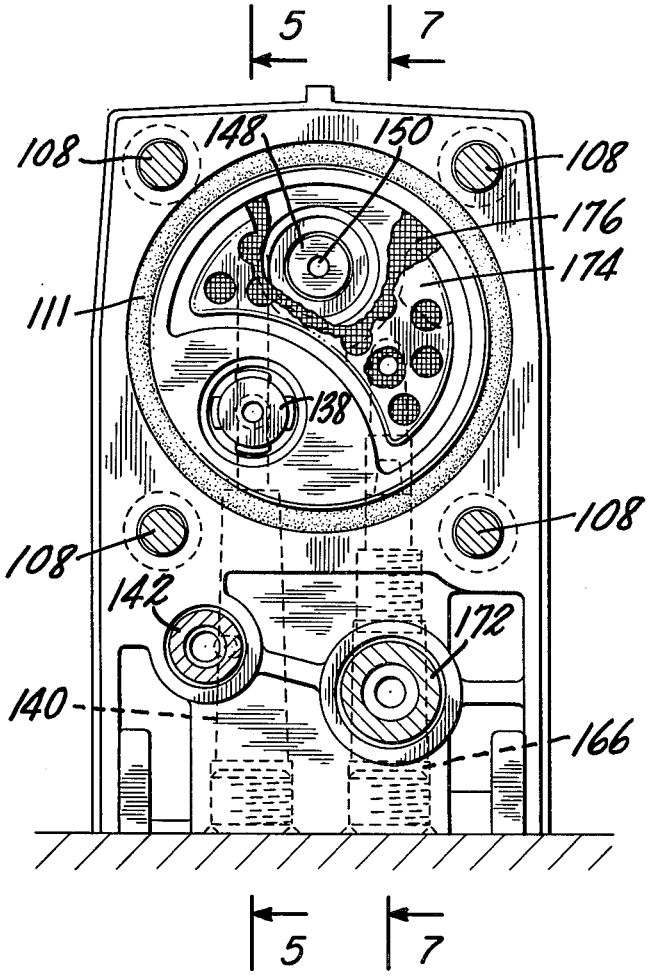
FIG. 8 is an end sectional view taken generally along the line 8—8 of FIG. 5.

Referring to FIG. 7 of the drawings, a third flow path between the two sections in the cylinder 110, which path, as is evident from FIGS. 6 and 8, is vertically displaced from the first two flow paths, includes a passage 166 in the end housing member 104, which receives a constant resistance orifice 168 to control the fluid flow, and a solenoid-controlled valve 170, which communicates, through boss 135*a*, with the reservoir 134 and, through a connector 172, with the passage 166.

It should be noted at this point that the ends of the pressure relief valve 144 and the passage 166 that communicate with the second section 110*s* of the cylinder 110 are covered with filter screens 174 and 176, as shown in FIG. 8. These screens are mounted on the end housing member 104 and prevent the intricate mechanisms of the pressure relief valve 144 and the solenoid controlled valve 170 from being clogged by impurities in the hydraulic fluid.

Figure 10:
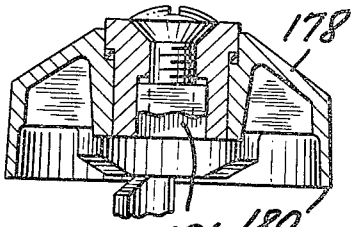
FIG. 10 is sectional view of the cam taken along the line 10—10 of FIG. 6.
Figure 9:
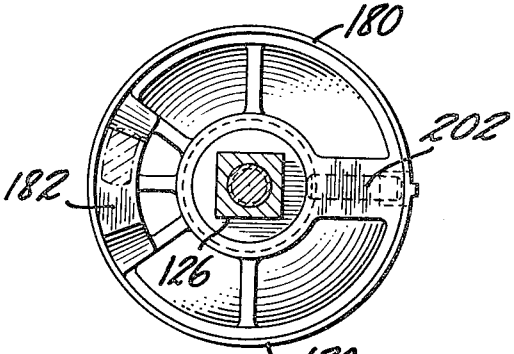
FIG. 9 is plan view of the cam of the sensing device taken along the line 9—9 of FIG. 6.
Figure 12:
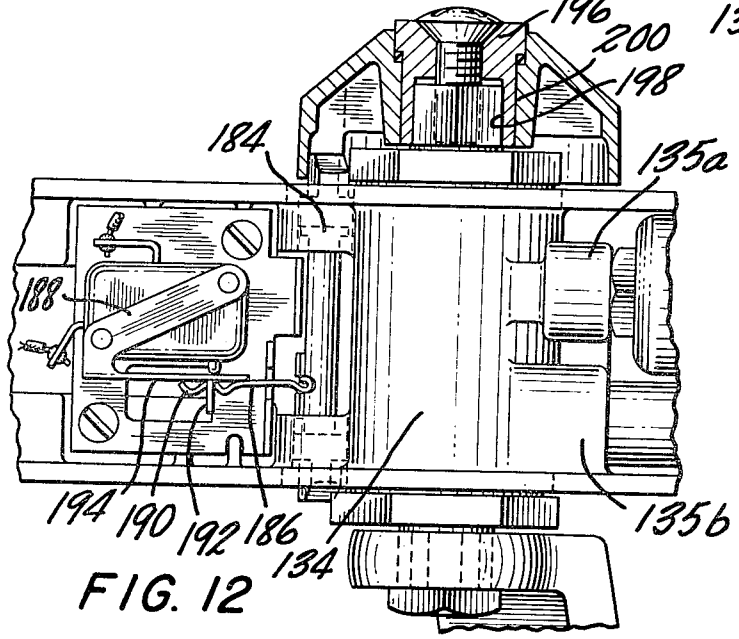
FIG. 12 is a front partial sectional view of the cam and the switch of the sensing device.

The details of an appropriate form of sensing device for determining when the door is in a position between just slightly open and fully closed are illustrated in FIGS. 9, 10 and 12 of the drawings. As shown in FIG. 10, a cam 178 is affixed outside the door holder housing on the shaft 126 which supports the pinion gear 124. The cam 178 is circular in plan and has a narrow, vertical wall 180 along its perimeter. One portion of the wall 180, however, is thicker and protrudes radially inwardly to form a protrusion 182 that is bevelled at its ends upwardly and outwardly. A plunger 184 extends through the central housing member 106, parallel to and laterally displaced from the shaft 126, as shown in FIG. 12, and has a surface complementary to and coacting with the protrusion 182. Accordingly, the bevelled ends of the protrusion 182 will easily pass over the end of the plunger 184 and depress it as it projects from the housing member 106. The cam 178 is arranged on the shaft 126 such that at substantially any open position of the door, only the normal wall of the cam is adjacent the plunger 184, as shown in FIG. 12. However, when the door assumes a position between just slightly open and fully closed, the protrusion 182 is oriented over the end of the plunger 184 and depresses it, as shown in FIG. 6. This manipulates a follower arm 186, which is operatively coupled to the plunger 184 at an intermediate point along its length. The arm 186 opens a switch 188 which is electrically connected to the solenoid valve 170 and thereby opens the valve, allowing the door to close fully.

As shown in FIG. 12, one end 190 of the follower arm 186, having a W-shaped configuration, is balanced at the midpoint of the W by a support 192 extending from the switch 188. A resilient switch arm 194 lies across the top of the W-shaped end 190. The resilience of the switch arm 194 maintains the follower arm 186 in a balanced, neutral position on the support 192 and thereby also supports the plunger 184 which is coupled to the opposite end of the arm 186 and which would fall freely through the housing member 106 if not supported. When the plunger 184 is depressed by the cam protrusion 182, the follower arm 186 rocks about support 192 and raises the switch arm 194 to open the switch 188. As the protrusion 182 releases the plunger 184, the resilience of the switch arm 194 causes the system to return to its neutral position.

A further beneficial feature of the above described switch system is that it may be conveniently mounted with the door holder on either a left or right hand opening door by simply inverting the holder as appropriate. The connecting arm 128 of the articulating linkage is attached to the upper end of the square ended shaft 126 and the cam 178 is mounted on the lower end using the insert adapter 196, which has a square inner bore 198 and a cylindrical outer surface 200. The sensing device is adjusted to its proper position by rotating the cam 178 about the adapter 196 and then securing it with a set screw 202.

The above described embodiment of the invention is intended to be merely exemplary, and numerous variations and modifications of it will be readily apparent to those skilled in the art without departing from the spirit and scope of the invention. All such variations and modifications are intended to be included within the scope of the invention as defined in the appended claims.

I claim:

1. A controlled release door holder comprising a housing having a portion defining a cylinder for containment of a fluid, a piston received in the cylinder for axial movement therein, the piston dividing the cylinder into a first variable volume section on one side of the piston and a second variable volume section on the other side of the piston, a spring in the first section of the cylinder compressed between the housing and the piston to urge the piston in a direction in the cylinder to reduce the volume of the second section of the cylinder, and increase the volume of the first section, means responsive to any movement of the door relative to the door opening for moving the piston axially in the cylinder a distance that is a function of the degree of such movement of the door, the movement of the piston being in the direction of the spring to compress it as the door is moved in a direction from closed to open, a first fluid flow path in the housing, the first flow path affording flow of fluid from the first section to the second section and including a check valve for preventing flow of fluid through the first path from the second section to the first section, a second fluid flow path in the housing, the second flow path affording flow of fluid from the second section to the first section and including a pressure relief valve for preventing fluid flow therethrough in the absence of the generation of a set minimum pressure in the second section, a third fluid flow path in the housing, the third fluid flow path affording flow of fluid from the second section to the first section, a controllable valve in the third flow path for selectively preventing or permitting fluid flow along said third path, and a sensing means responsive to the position of the door relative to the door opening to open the controllable valve when the door is in any position between slightly opened and fully closed to enable flow of fluid from the second section to the first section.

2. A door holder according to claim 1 wherein the sensing means includes a cam formed to represent said any position of the door and driven in coordination with the movement of the piston and a switch actuated by the cam.

3. A door holder according to claim 2, wherein the sensing means further includes an elongated plunger, operatively coupled to said switch and movable generally axially, the cam being rotatable about an axis parallel to and laterally spaced from the longitudinal axis of the said plunger and having an enlargement for contacting one end of the plunger and depressing it, when the cam assumes a predetermined position relative to the plunger, thereby actuating the switch.

4. A controlled release door holder for a door comprising a coacting piston and cylinder for causing fluid to flow in and out of the cylinder, the piston coupled to the door and movable therewith for flowing the fluid in response to opening and closing movement of the door, a spring acting on the piston for biasing the door toward closing movement, a first flow path for the fluid into the cylinder during opening movement of the door including a check valve for preventing fluid flow therealong during holding or closing movement of the door, a second flow path for the fluid out of the cylinder during manual closing movement of the door including a pressure relief valve for permitting fluid flow therealong in the presence of a set minimum fluid pressure above the pressure created by the spring acting on the piston, a third flow path for the fluid out of the cylinder during closing movement of the door in response to the spring acting on the piston including a controllable valve for selectively preventing or permitting fluid flow therealong, means for opening the controllable valve in the third flow path to permit the spring to close the door, and control means coupled to the piston for moving the fluid and responsive to a selected open position of the door for opening the controllable valve to facilitate door closure.

5. A door holder as set forth in claim 4, wherein the controllable valve includes a solenoid, and the control means which actuates the solenoid includes a cam rotated in coordination with the piston and a switch electrically connected to the solenoid and thrown by the cam in the selected open position of the door.

* * * * *

UNITED STATES PATENT AND TRADEMARK OFFICE

CERTIFICATE OF CORRECTION

PATENT NO. : 4,267,619

DATED : May 19, 1981

INVENTOR(S) : Charles R. Suska

It is certified that error appears in the above-identified patent and that said Letters Patent are hereby corrected as shown below:

Col. 10, line 9, after "cam" insert --to open said controllable valve--.

Signed and Sealed this

*Twenty-seventh* Day of *October 1981*

[SEAL]

*Attest:*

GERALD J. MOSSINGHOFF

*Attesting Officer*

*Commissioner of Patents and Trademarks*